US006974318B2

(12) United States Patent
Ahn et al.

(10) Patent No.: US 6,974,318 B2
(45) Date of Patent: Dec. 13, 2005

(54) ONLINE BAKEOUT OF REGENERATIVE OXIDIZERS

(75) Inventors: Sunjung Ahn, Ann Arbor, MI (US); Donald I. McAnespie, Tecumseh (CA); Jason T. Schroeder, New Hudson, MI (US)

(73) Assignee: Dürr Environmental, Inc., Plymouth, MI (US)

( * ) Notice: Subject to any disclaimer, the term of this patent is extended or adjusted under 35 U.S.C. 154(b) by 0 days.

(21) Appl. No.: 10/818,315

(22) Filed: Apr. 5, 2004

(65) Prior Publication Data

US 2005/0227189 A1 Oct. 13, 2005

(51) Int. Cl.[7] ..... F27D 17/00
(52) U.S. Cl. ..... 432/180; 122/1 A; 165/10
(58) Field of Search ..... 432/179, 180, 432/181; 165/8, 9, 10; 122/1 A

(56) References Cited

U.S. PATENT DOCUMENTS

| | | | | |
|---|---|---|---|---|
| 5,562,442 | A | 10/1996 | Wilhelm | |
| 5,871,349 | A * | 2/1999 | Johnson et al. | 432/180 |
| 5,915,340 | A * | 6/1999 | Cronin et al. | 122/1 A |
| 6,145,582 | A * | 11/2000 | Bolle et al. | 165/10 |
| 6,203,316 | B1 | 3/2001 | Pennington | |

* cited by examiner

*Primary Examiner*—Gregory Wilson
(74) *Attorney, Agent, or Firm*—Howard & Howard

(57) ABSTRACT

A method of burning off accumulated contaminants from heat sink media of a regenerative oxidizer having a plurality of segments containing media arranged around a central axis and a rotary valve which includes repeatedly rotating the rotary valve 180 degrees to alternatively direct waste gas through a first plurality of segments, direct the hot gas through a second plurality of segments and purge gas through a third segment to burn off the contaminants, then indexing the rotary valve one segment and repeating the burn-off process of all segments.

5 Claims, 3 Drawing Sheets

ONLINE BAKEOUT OF REGENERATIVE OXIDIZERS

FIELD OF THE INVENTION

This invention relates to an improved method of cleaning and removing accumulated particulate and condensable matter from the media or heat sink of regenerative oxidizers by burning or banking off the deposited matter without interrupting processing of waste gases through the oxidizer. That is, the regenerative oxidizer continues online operation without interruption during the bakeout procedure.

BACKGROUND OF THE INVENTION

Regenerative oxidizers (RO), including regenerative thermal oxidizers (RTO) and regenerative catalytic oxidizers (RCO), use a large mass of media or heat sink, usually ceramic based, to provide a high degree of recovery. Typically, the heat sink media of a regenerative oxidizer is in the form of saddles, glued laminated sheets or extruded honeycomb monoliths. Because of the economic benefits of regenerative oxidizers, a large number of polluted gaseous streams are abated by regenerative oxidizers. In some applications, in addition to volatile organic compounds (VOCs), particulate or condensable matter is also present in the waste gas stream and may accumulate in the heat sink media. If the quantity of these fouling agents is sufficient, then the flow passages through the heat sink media can be compromised, causing loss of efficiency of the regenerative oxidizer, or malfunction. In such cases, either the media is washed or heated to burn or bake off the accumulated matter. The process of burning or baking off contaminants is generally referred to as "bakeout." In this process, the accumulated matter is oxidized to gases or volatilized to gaseous form or converted to a combination of the two forms.

In a bakeout procedure, the heat sink is gradually heated, using the regenerative oxidizer burner or an outside source, to a temperature at which the deposited matter is oxidized (destroyed) and/or volatilized. In most cases, this procedure is performed under an "offline" condition, wherein the regenerative oxidizer is not abating the polluted waste gas stream or is in a maintenance mode. This often implies down time for the process to which the regenerative oxidizer is applied and hence loss of production time. A more preferred procedure would be to carry out the bakeout in an online condition, while processing polluted gaseous streams.

U.S. Pat. No. 6,203,316 assigned to a predecessor in interest of the assignee of this application discloses a proposed continuous online smokeless bakeout process for rotary oxidizers, which is one type of regenerative oxidizer, having a rotary valve as described further below. This patent proposes to operate the rotary oxidizer in a normal manner, but to add heat to the purge gas using a burner. However, testing of the bakeout process disclosed in this patent indicated that the residence time of the heated purge gas is insufficient to burn off accumulated non-volatile contaminants from the heat sink media using the method described in the above-referenced U.S. Pat. No. 6,203,316. Further, it is not possible to simply hold the position of the rotary valve for a time sufficient for bakeout or burn-off of the accumulated non-volatile contaminants without compromising the efficiency of the rotary regenerative oxidizer, because it has been found that bakeout of the accumulated non-volatile contaminants takes between ten to ninety minutes or more preferably about fifty minutes. Thus, a need continues for a method of cleaning the heat sink media of a rotary regenerative oxidizer of accumulated contaminants while continuing operation of the rotary regenerative oxidizer.

SUMMARY OF THE INVENTION

As set forth above, this invention relates to a method of cleaning the heat sink media of a rotary-type regenerative oxidizer, of accumulated contaminants while continuing the processing of contaminants present in the waste gases through the regenerative oxidizer for destruction of contaminants without compromising the efficiency of the regenerative oxidizer. As used herein, the term regenerative oxidizer includes both rotary regenerative thermal oxidizers and rotary regenerative catalytic oxidizers as set forth above. As will be understood by those skilled in this art, a rotary regenerative oxidizer includes a plurality of pie-shaped segments or compartments each of which have heat sink media therein. As set forth above, the heat sink media may be in any suitable form, such as saddles, glued laminated sheets, extruded honeycomb monoliths or other forms. As used herein, the term "pie-shaped," refers to the general configuration of the segments or compartments which receive the heat sink media, which typically includes a V-shape and generally, but not necessarily, a circular outer surface, such that the outer surfaces of the pie-shaped compartments define a circle and the inner walls define radii of the circle. Thus, although the outer surfaces of the pie-shaped compartments are preferably segments of a circle, the shape of the outer wall is not necessarily a segment of a circle. Further, a rotary regenerative oxidizer may include any number of pie-shaped compartments, but for the purposes of this disclosure only, it will be assumed that the rotary regenerative oxidizer includes twelve pie-shaped compartments.

A rotary regenerative oxidizer further includes a combustion chamber located opposite the pie-shaped compartments and communicating therewith. In a typical application, the combustion chamber is located above the heat sink media in the pie-shaped compartments. The rotary regenerative oxidizer then includes a waste gas stream inlet and a rotary valve, sometimes referred to as a diverter valve, which directs the waste gas stream into a first plurality of adjacent pie-shaped compartments containing heat sink media. The waste gas stream is then received in the combustion chamber where volatile organic contaminants in the waste gas stream are oxidized, forming a hot clean gas stream. The rotary valve then directs the hot clean gas stream through a second plurality of adjacent pie-shaped compartments, opposite the first plurality of pie-shaped compartments, heating or regenerating the heat sink media in the second plurality of adjacent pie-shaped compartments. In a typical application where the rotary regenerative oxidizer includes a purge cycle, the rotary valve further directs clean purge gas (ambient air or oxidized clean air) into a third pie-shaped segment located between the first and second plurality of pie-shaped segments.

The clean purge gas could be drawn from the combustion chamber, from ambient atmosphere or from the oxidizer stack. All these locations supply clean gas which is required for purging the sector between the first and second pluralities of adjacent pie-shaped segments. When the purge gas is drawn from the combustion chamber, it is called "Downward Purge," referring to the direction of travel of the gases. Similarly, when the purge gas is drawn from the ambient atmosphere or from the oxidizer stack, the gas flow must travel up through the heat sink media in order to perform the purge function and hence termed "Upward Purge."

For the purposes of general description only, both purge schemes, upward and downward, have been described as heated purge in the following sections.

The rotary valve further includes a fourth segment between the first and second plurality of adjacent pie-shaped segments, diametrically opposite to the third pie-shaped segment. In normal operation, the rotary valve is indexed or rotated one pie-shaped segment at a time and the process is repeated indefinitely. In a typical application, the rotary valve is rotated 360 degrees through a full cycle in about three minutes.

Thus, assuming for purposes of description only that the rotary regenerative oxidizer includes twelve pie-shaped segments or compartments, five pie-shaped compartments normally receive the waste gas stream, which is the first plurality of adjacent pie-shaped compartments, five pie-shaped compartments normally receive the hot clean gas stream, which is the second plurality of adjacent pie-shaped segments, at least one pie-shaped compartment receives the heated purge gas stream, which is the third pie-shaped compartment, and one pie-shaped compartment, which is referred to as the fourth pie-shaped section above, is either idle or receiving heated purge gas as the rotary valve is rotated. Depending upon the design of the rotary regenerative oxidizer, the heated purge gas may be either directed upwardly or downwardly by the rotary valve. Thus, for example, compartments or segments 1 to 5 initially receive the waste gas stream, segments or compartments 7 to 11 initially receive the hot clean gas from the combustion chamber and at least one of compartments 6 and/or 12 initially receive purge gas. The rotary valve is then indexed one pie-shaped compartment to direct waste gas to compartments 2 to 6, hot clean gas to compartments 8 to 12 and at least one of compartments 1 and/or 7 receive heated purge gas, etc.

As will be understood by those skilled in this art, the purge gas may be directed downwardly or upwardly through the heat sink media of at least one segment or compartment depending upon the design of the regenerative oxidizer. In a downward purge, hot oxidized clean air from the combustion chamber is pulled downwardly through at least one segment, referred to herein as the third segment, to clean trapped dirty waste gas in the segment to enhance the destruction efficiency of the regenerative oxidizer. In the beginning, the downward purge gas is hot but as it travels down through the heat sink media, most of the heat is dissipated and the heat sink media and purge gases become ambient at the exit point. However, if sufficient time is allowed, the heat sink media in a pie-shaped segment can become saturated with heat allowing downward purge gases to become hot at the exit location, wherein accumulated matter is typically present, thus initiating bakeout.

Alternatively, in an upward purge, clean gas (ambient or from the oxidizer stack) is pushed upwardly through the third pie-shaped segment, thus pushing the trapped waste gas in that segment into the combustion chamber for destruction of volatile organic compounds. In this case, a separate fan may also be used for this purpose. However, in a typical arrangement, a portion of the clean exhaust gas of the regenerative oxidizer is directed upwardly. In an upward purge, the purge gas is preferably heated by an auxiliary heater, as disclosed below, wherein ambient atmosphere is heated prior to directing the purge gas upwardly. As thus far described, the operation of the rotary regenerative oxidizer is conventional.

However, as set forth above, the waste gas may include non-volatile contaminants in addition to the volatile organic compounds in the form of particulate or condensable matter which accumulates in the heat sink media and foul the passages through the heat sink media, causing malfunction of the regenerative oxidizer. The method of this invention, however, accomplishes removal or cleaning of such accumulated matter without interrupting the processing of waste gas through the rotary regenerative oxidizer for the purpose of cleaning.

Various methods can be employed to effect bakeout of accumulated matter in a rotary regenerative oxidizer depending on the direction of the purge and type of valve design.

One method of cleaning the heat sink media of a rotary regenerative oxidizer of this invention utilizing a downward purge, includes first locating the rotary valve in a first position to direct the waste gas stream through a first plurality of adjacent pie-shaped compartments and into the combustion chamber, directing the hot clean gas stream from the combustion chamber through a second plurality of adjacent pie-shaped compartments and directing purge gas through a third pie-shaped compartment between the first and second plurality of pie-shaped compartments as described above. The rotary valve may also direct purge gas through the fourth pie-shaped compartment or the fourth compartment may be idle, as described above.

The method of this invention then includes rotating the rotary valve 180 degrees to direct the waste gas stream through the second plurality of adjacent pie-shaped compartments and the hot clean gas stream through the first plurality of adjacent pie-shaped compartments and the hot purge gas through the fourth pie-shaped compartment. That is, the gas flow through the first and second plurality of adjacent pie-shaped compartments is reversed with each 180 degree rotation. The rotation can be clockwise or counter-clockwise or successively in the same or the opposite directions.

This is necessary for the processing of the waste gas through the regenerative oxidizer for destruction of contaminants or for "online" operation of the regenerative oxidizer. The rotary valve is then repeatedly rotated 180 degrees for a time that provides sufficient for the heat to percolate down the combustion chamber downward with the downward purge to bakeout accumulated contaminants in the heat sink media in the third and fourth pie-shaped compartments. If the rotary valve is designed to have purge gas pass through only one segment, referred to as the third segment, then the third and the fourth compartments will be bakeout successively, about a minute apart, depending upon the rotational speed of the rotary valve. However, if the rotary valve has been designed to allow passage of purge gas through the third and the fourth segments, the two compartments will be baked-out simultaneously. Upon completion of the bakeout of the third and fourth pie-shaped compartments, the rotary valve is then rotated or indexed one pie-shaped compartment and the above-mentioned process is repeated until the accumulated non contaminants are baked-out of the heat sink media in all of the pie-shaped compartments or segments of the rotary regenerative oxidizer.

As will be understood, one or two segments of the regenerative oxidizer, referred to as the third and fourth segments above, will be receiving heated purge gas during the bakeout cycle depending upon the design of the rotary valve. Where the rotary valve directs purge gas to both the third and fourth segments or compartments containing heat sink media, both segments continue to receive heated purge gas following each 180 degree rotation of the rotary valve.

Thus, the method of this invention is identical to the method described above, except that the bakeout time is shortened by one-half.

It has been found during testing that complete bakeout of accumulated matter in the heat sink media in a segment or compartment takes anywhere from 45 to 90 minutes. During the online bakeout cycle, the valve rotates 180 degrees, as described earlier, every 60 to 120 seconds, preferably about 75 seconds. Thus, it takes approximately 60 to 30 rotations to initiate bakeout in two segments, where the rotary regenerative oxidizer includes twelve segments. For complete bakeout of the rotary regenerative oxidizer, the rotary valve would be rotated approximately 288 to 144 rotations or four and a half hours to nine hours. However, this time may be decreased by employing an upward purge scheme wherein temperature of the purge gas is increased by an auxiliary burner as disclosed in the above-referenced U.S. Pat. No. 6,203,316. As will be understood, however, ten segments of a rotary regenerative oxidizer having twelve segments will be operating normally during the bakeout procedure, thus avoiding interruption of the waste gas stream or taking the rotary regenerative oxidizer off line. It has also been found that in a preferred embodiment, the rotary valve is rotated by means of a programmable electric drive to permit accurate rotation of the rotary valve through 180 degrees during the bakeout procedure.

Another preferred embodiment of this invention utilizes an auxiliary heat source, such as a burner, with an upward purge. In this embodiment, the regenerative oxidizer preferably includes a duct receiving heated clean gas from the outlet of the regenerative oxidizer directing clean gas to the stack or from the ambient atmosphere. This duct may include an auxiliary heater, such as a burner, which heats the gas, and the heated gas is then directed upwardly through the third and fourth sectors depending upon the design of the rotary valve. Thus, an elevated temperature of the purge gas can be achieved which is not a function of time. This method thus reduces the bakeout time of the accumulated particulate and condensable matter in the third and fourth sectors, thus reducing the required bakeout time. As will be understood, the fastest method of completing the bakeout would be an upward purge with an auxiliary burner wherein the heated purge gas is directed to both the third and fourth segments.

Thus, the method of cleaning the heat sink media of a regenerative oxidizer of this invention is relatively simple, can be electronically controlled and provides for continued cleaning of the waste gases through the regenerative oxidizer during the bakeout procedure.

DESCRIPTION OF THE PREFERRED EMBODIMENTS

Figure 1:
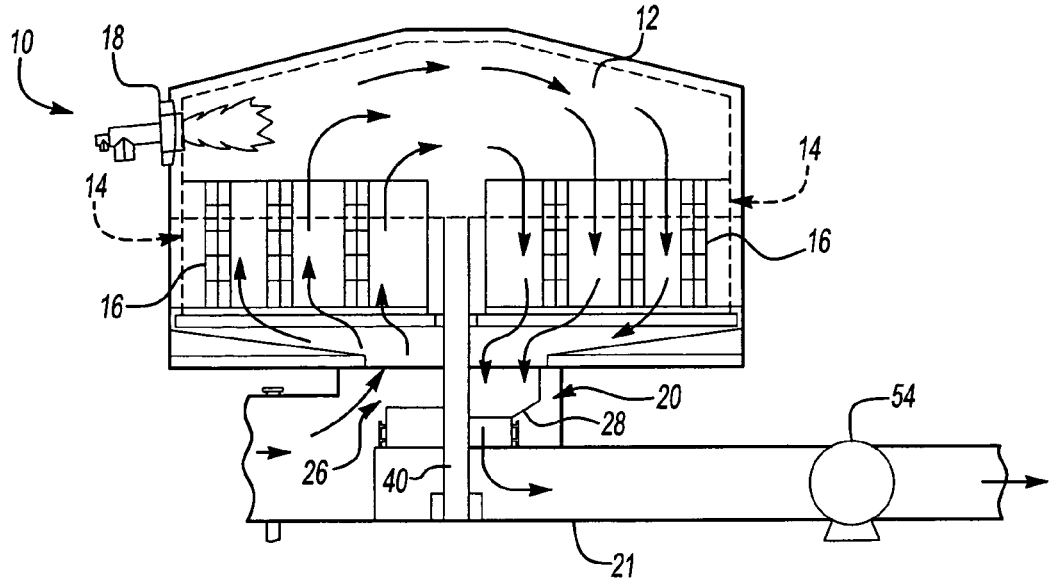
FIG. 1 is a side partially cross-sectioned view of a conventional rotary regenerative oxidizer which may be utilized in the method of this invention.

The rotary regenerative oxidizer 10 illustrated in FIG. 1 is generally conventional for illustrative purposes only and thus does not limit the method of cleaning the heat sink media of this invention, except as set forth in the appended claims. The illustrated rotary regenerative oxidizer 10 includes a combustion chamber 12, pie-shaped compartments or segments 14 each including heat sink media 16 therein as described above. A burner 18 heats the gas in the combustion chamber 12 to a temperature sufficient to oxidize the volatile organic compounds received therein, typically to a temperature generally about 600° F. The pie-shaped compartments or segments 14 are open at both ends to communicate with the combustion chamber 12 at one end and the rotary valve 20 at the other end, the components of which are shown in detail in FIG. 2. A stator 24 is located between the rotary valve 20 and the lower open ends of the pie-shaped compartments 14 shown in FIG. 2.

Figure 4:
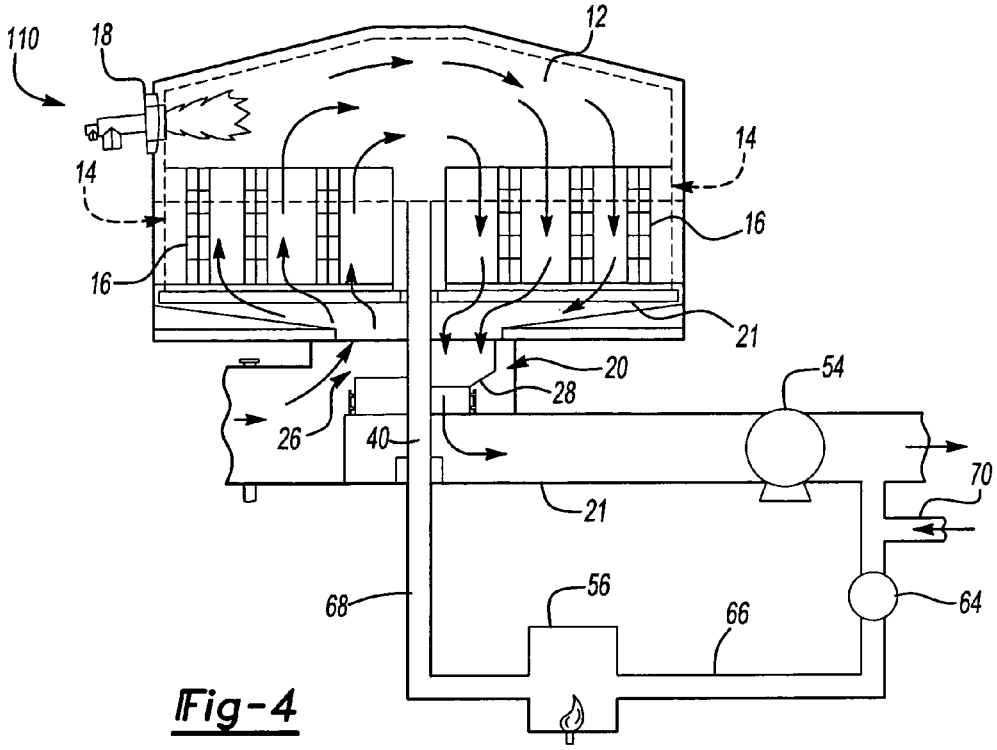
FIG. 4 is a side partially cross-sectioned view of an alternative embodiment of a rotary regenerative oxidizer which may be utilized in the method of this invention.

The waste gas stream containing entrained contaminants is received through an inlet 26 of the rotary regenerative oxidizer 10 as shown in FIG. 4 and the clean gas is returned through an outlet 28 where the clean gas is received through an outlet conduit 21 which may be directed to atmosphere. In most applications, the gas will be air.

Figure 2:
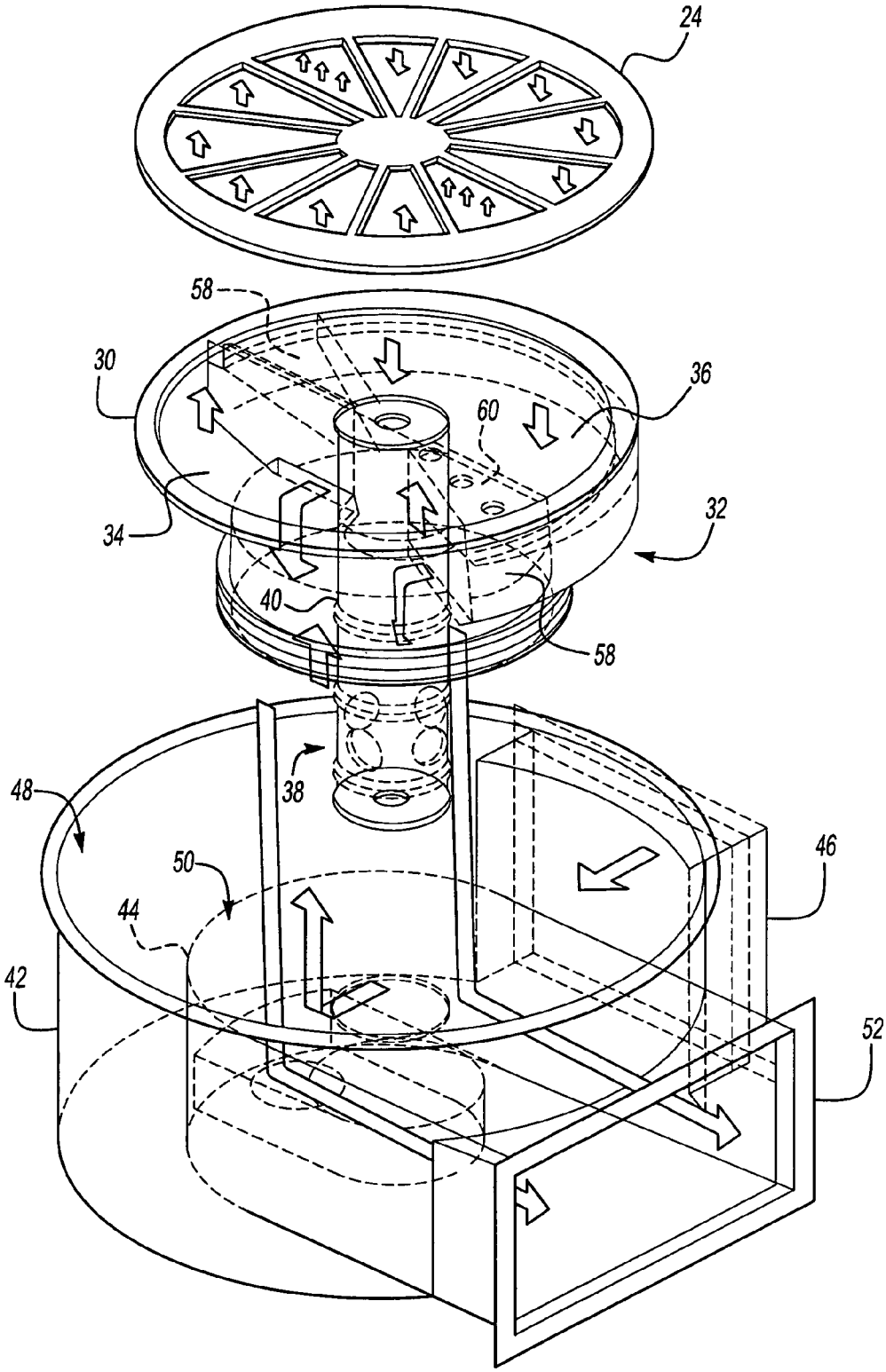
FIG. 2 is an exploded view of the rotary valve illustrated in FIG. 1.

The rotary valve shown in FIG. 2 includes a valve plate 30 affixed to the top of the valve rotor 32 for directing the flow of gas through the rotary regenerative oxidizer 10. The valve plate 30 includes a plurality of pie-shaped inlet ports 34, a plurality of pie-shaped outlet ports 36 and a purging port 60 communicating with purge supply port 38. The pie-shaped inlet and outlet ports 34 and 36 correspond to the pie-shaped compartments 14 as known in this art. The valve rotor 32 rotates about a tubular member 40 projecting vertically through an outlet housing 44 having a smaller diameter than the valve housing 42, and is located within the valve housing 42. Waste gas, such as air with entrained contaminants passes through the inlet plenum 46 into the inlet chamber 48 defined between the valve housing 42 and the outlet housing 44. The waste stream is then channeled through the inlet ports 34 and into a first plurality of adjacent pie-shaped compartments or segments 14 as described above. Because the heat sink media 16 and all of the pie-shaped heat sink compartments 14 are heated during a full cycle of the rotary valve 20, waste gas traveling upwardly through the segments, elevates the temperature of the heat sink media in all of the segments. The waste gas is then received from the first plurality of pie-shaped compartments 14 into the combustion chamber 12, where the volatile organic compounds are oxidized. The clean hot gas stream is then directed by the rotary valve 20 from the combustion chamber 12 into a second plurality of pie-shaped compartments 14 wherein heat is transferred to the heat sink media 16 and cooler gases pass through outlet ports 36 into an outlet chamber 50 located within the outlet housing 44. The hot clean gas stream is then channeled out of the outlet chamber 50 through an outlet plenum 52 through duct 21 generally to an exhaust stack (not shown) where it may be vented to atmosphere.

As will be understood by those skilled in this art, proper pressure differential is created between the inlet 26 and the outlet 28 of the rotary valve 20 for directing the flow of gas through the rotary regenerative oxidizer 10. Location of fan 54 upstream or downstream of the rotary regenerative oxidizer 10 is responsible for the positive or negative pressure differential respectively. In FIG. 4, fan 54 is located in the outlet duct 21 downstream from the outlet plenum 52 for creating a negative pressure differential. Alternatively, the fan 54 may be located at the inlet prior to receipt of the waste gas in the inlet 26 or a conduit connected to the inlet (not shown) to establish a positive pressure for creating the required pressure differential between the inlet plenum 46 and the outlet 50, directing the flow of gas through the rotary regenerative oxidizer 10.

As set forth above, the rotary valve 20 also directs heated purge gas through one or both of the third and fourth pie-shaped compartments or sections located between the first and second plurality of adjacent pie-shaped compartments. The disclosed embodiment of the rotary valve 20 includes a purge chamber 58 and the valve plate 36 includes a purge port 60 having a plurality of apertures 62 which direct the heated purge gas into both the third and fourth pie-shaped compartments or segments. In the embodiment of the valve plate 130 shown in FIG. 5, the valve plate 130 includes a purge port 160 having a plurality of purge apertures 162. However, the opposed segment 163 is closed, such that the segment or pie-shaped compartment opposite the segment 163 is idle. Both designs are presently used in rotary regenerative oxidizers. As set forth above, the heated purge gas may be either directed upwardly through one or both of the third and fourth segments 14 or downwardly from the combustion chamber 12 depending upon the design of the valve plate 30 or 130 and the regenerative oxidizer. The operation of the rotary regenerative oxidizer 10 to bakeout the accumulated contaminants from the heat sink media 16 of this invention may now be described with reference to the figures, as follows.

Figure 3:
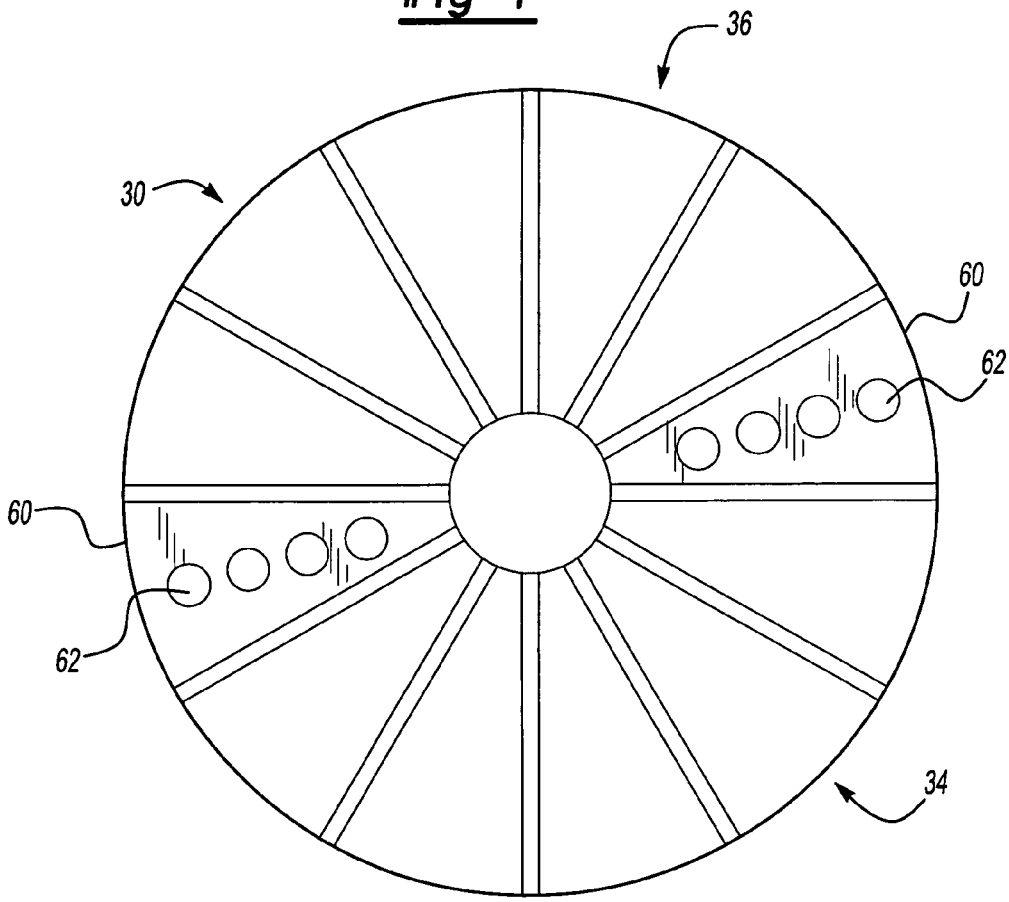
FIG. 3 is a top view of the valve plate of the rotary valve illustrated in FIG. 2.

First, the valve rotor 32 of the rotary valve is positioned to direct the waste gas stream received through the inlet 26 into a first plurality of adjacent pie-shaped compartments through the inlets 34 of the valve plate 30 shown in FIG. 3. In the disclosed embodiment, wherein the regenerative oxidizer includes twelve pie-shaped compartments 14, the inlet ports 34 includes five pie-shaped openings directing waste gas into five pie-shaped compartments 14 including heat sink media 16 as described above. The waste gas stream is then received from the first plurality of pie-shaped compartments 14 into the combustion chamber 12 where the remaining volatile organic compounds are oxidized. The hot clean gas is then directed by the rotary valve 20 into a second plurality of opposed adjacent pie-shaped compartments 14 by the openings 36 through the valve plate 30, as described above, and hot clean gas is then received through the outlet 28 of the rotary valve 20 into the outlet duct 21 and vented to atmosphere. In the embodiment of the valve plate 30 shown in FIG. 3, wherein the valve plate 30 includes apertures 62 at both the third and fourth positions described above, heated purge gas is directed into the third and fourth pie-shaped compartments located between the first and second plurality of adjacent pie-shaped compartments as will be understood from FIG. 3. Alternatively, where the valve plate 130 includes apertures 162 through only one side of the valve plate and the opposed segment 163 is closed, the fourth pie-shaped compartment is at idle.

Figure 5:
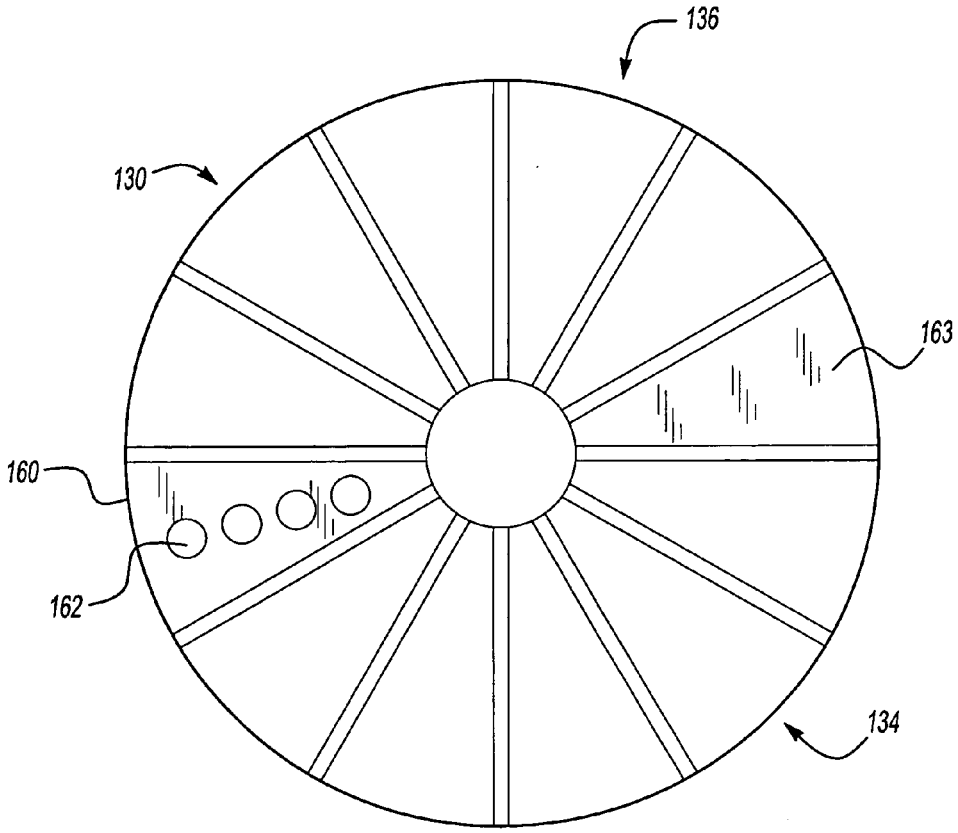
FIG. 5 is a top view of an alternative embodiment of the valve plate.

The disclosed embodiment of the method of cleaning the heat sink media of a rotary regenerative oxidizer of accumulated non-volatile contaminants of this invention then includes rotating the rotary valve 20 one hundred eighty (180) degrees, wherein the outlet openings 36, 136 of the valve plate 30 become the inlet openings, directing waste gas into the second plurality of pie-shaped compartments or segments 14 and the inlet openings 34, 134 direct the hot clean gas to the outlet 28 of the rotary regenerative oxidizer. That is, the gas flow through the rotary valve 20 is reversed. However, one or both of the third or fourth pie-shaped compartments receive heated clean purge gas depending upon the design of the valve plate 30 as shown in FIGS. 3 and 5. The rotary valve 20 is then repeatedly rotated 180 degrees until the residence time of the heated purge gas is sufficient to bakeout accumulated contaminants from the heat sink media 16 in the third or third and fourth pie-shaped compartments 14. When both third and fourth pie segments have purge ports 62, then bakeout of the heat sink media 16 in corresponding segments 14 occurs simultaneously. However, if only one segment 60 has purge ports 62, then heat sink media 16 in pie-shaped segments 14 in the third and fourth segments are baked-out successively with a time difference equal to time between two successive rotations. As will be understood from the above description, however, the rotary regenerative oxidizer 10 continues to receive and process waste gas through ports 34 or 36 during the bakeout procedure.

Following bakeout of the third and fourth pie-shaped compartments 14 with heated purge gas, as described above, the rotary valve 20 is then indexed or rotated one pie-shaped segment 14 or 30 degrees, where the rotary regenerative oxidizer includes twelve segments, and the bakeout procedure described above is repeated until the accumulated non-volatile contaminants are burned off in all of the pie-shaped compartments or segments 14.

FIG. 4 illustrates an alternative embodiment of a rotary regenerative oxidizer 110 which includes a heating element, such as a burner 56, to increase the temperature of the purge gas which may be utilized to improve the efficiency of the bakeout procedure described above. In the embodiment of the rotary regenerative oxidizer 110 shown in FIG. 4, a purge fan 64 is provided in a conduit 66 receiving the hot clean gas through the outlet duct 21, which is directed to the burner 56 and the heated gas is then directed through conduit 68 to the tubular member 40 shown in FIG. 2, further heating the purge gas received through one or both of the third and fourth pie-shaped compartments or segments 14 as described above with regard to FIGS. 3 and 5. Atmospheric air may also be received in inlet line 70 and used in the purge cycle. The method of cleaning the heat sink media of the rotary regenerative oxidizer 110 is otherwise identical to the method described above with regard to the rotary regenerative oxidizer 10 shown in FIG. 1. That is, during the bakeout sequence, the rotary valve 32 is repeatedly rotated 180 degrees to bakeout the third and fourth pie-shaped compartments described above and the rotary valve is then indexed and the bakeout procedure is repeated until the heat sink media in all of the pie-shaped compartments 14 are cleaned. Following bakeout, the rotary regenerative oxidizer is reverted to normal operation of the rotary valve wherein the valve may only be indexed 30 degrees at a time.

As will be understood by those skilled in this art, there are various designs of regenerative oxidizers and the method of this invention may be utilized with any conventional regenerative oxidizer, but is particularly suitable for regenerative oxidizers having a rotary valve directing the flow of gas through the regenerative oxidizer. As will be understood by those skilled in this art, there are suitable bakeout procedures for other types of regenerative oxidizers having multiple towers and multiple valves. However, the prior art does not include an online bakeout procedure for regenerative oxidizers having a rotary valve. Further, the embodiments of the regenerative oxidizer disclosed herein may include any number of pie-shaped compartments 14. As set forth above, the heated purge gas may be directed upwardly as shown in FIG. 4 of this application or directed downwardly as is known in this art. As set forth above, the method of this invention may be utilized either with a downward purge, wherein heated clean gas is received from the combustion chamber and directed downwardly through the third segment or the third and fourth segments. Alternatively, in an upward purge, the gas may be directed from the outlet of the regenerative oxidizer with auxiliary heating upward through the third and fourth segments. In both methods, the purge gas is heated. Having described preferred embodiments of the method of cleaning the heat sink media of a rotary regenerative oxidizer of accumulated contaminants of this invention, the invention is now claimed as follows.

As will be understood from the above description, the method of cleaning and removing accumulated particulate and condensable matter from the heat sink media of a regenerative oxidizer of this invention may be performed in four alternative embodiment as follows. First, the method of this invention may be performed with a downward purge, with only one sector, namely the third sector, receiving heated purge gas from the combustion chamber, wherein the valve plate 130, shown in FIG. 5, includes apertures 162 on only one side of the valve plate. As set forth above, the rotary valve 20 is repeatedly rotated 180 degrees, reversing the gas flow through the regenerative oxidizer, maintaining efficient operation of the regenerative oxidizer during the bakeout procedure. Second, a method of this invention may be performed with a downward purge, wherein the valve plate 30 includes apertures 62 on both sides of the valve plate, such that both the third and fourth sectors receive heated purge gas from the combustion chamber, reducing the bakeout time. Third, the method of this invention may be utilized with an upward purge, wherein only one sector, namely the third sector, is receiving heated purge gas from the auxiliary heater 56 as shown in FIG. 4 and the valve plate 130 includes apertures 162 on only one side of the valve plate. Finally, in a fourth embodiment, where clean gas from the regenerative oxidizer 110 is heated with an auxiliary heater 56 and the valve plate 30 includes apertures 62 in the diametrically opposed sectors 60, as shown in FIG. 3, the heated purge gas is directed upwardly through two sectors, namely the third and fourth sectors, reducing the bakeout time. It is believed that this fourth embodiment will be the most efficient having the shortest bakeout time. Except for the direction of the heated purge gas and the number of sectors receiving purge gas, the method of this invention is the same.

Having described preferred embodiments of the method of cleaning the heat sink media of a rotary regenerative oxidizer of accumulated non-volatile contaminants of this invention, the invention is now claimed as follows.

What is claimed is:

1. A method of cleaning and removing accumulated contaminants from the heat sink media of a regenerative oxidizer having a plurality of adjacent segments each including heat sink media surrounding a central axis and a rotary valve directing gas flow through said regenerative oxidizer, said method comprising the following steps:

(a) locating said rotary valve in a first position directing a waste gas stream through a first plurality of adjacent segments, a hot clean gas stream through a second plurality of adjacent segments opposite said first plurality of adjacent segments and directing a heated purge gas into a third segment located between said first and second plurality of adjacent segments;

(b) rotating said rotary valve 180 degrees directing said waste gas stream through said second plurality of segments, thereby reversing gas flow through said regenerative oxidizer and directing said hot clean gas stream through said first plurality of segments and said heated purge gas stream into a fourth segment diametrically opposite said third segment;

(c) repeating step (b) multiple times to direct heated purge gas into said third and fourth segments for a time sufficient to burn off accumulated contaminants in said heat sink media in said third and fourth segments; and (d) then indexing said rotary valve one segment and repeating step (b) and (c) to burn off accumulated contaminants in said one segment and an opposed segment.

2. The method of cleaning the heat sink media of a regenerative oxidizer as defined in claim 1, wherein said method includes directing said heated purge gas through said fourth segment while directing heated purge gas through said third segment.

3. The method of cleaning the heat sink media of a rotary regenerative oxidizer as defined in claim 1, wherein said method includes heating an outlet gas of said regenerative oxidizer, then directing heated outlet gas upwardly into said third and fourth segments.

4. The method of cleaning the heat sink media of a rotary regenerative oxidizer as defined in claim 1, wherein said method includes directing purge gas through said fourth pie-shaped compartment.

5. A method of cleaning the heat sink media of a rotary regenerative oxidizer of accumulated contaminants while continuing to process waste gas, said rotary regenerative oxidizer including a plurality of pie-shaped compartments each having heat sink media therein, a combustion chamber located opposite said pie-shaped compartments and communicating therewith, an inlet receiving a waste gas stream containing contaminants, a rotary valve receiving said waste gas stream directing said waste gas stream into a first plurality of adjacent pie-shaped compartments, said waste gas stream then directed into said combustion chamber, oxidizing contaminants and forming a hot clean gas stream, said rotary valve then directing said hot clean gas stream from said combustion chamber through a second plurality of adjacent pie-shaped compartments opposite said first plurality of pie-shaped compartments, said rotary valve further directing purge gas through a third pie-shaped compartment located between said first and second plurality of pie-shaped compartments and said rotary regenerative oxidizer including a fourth pie-shaped compartment located diametrically opposite to said third pie-shaped compartment and located between said first and second plurality of adjacent pie-shaped compartments, said method comprising the following steps:

(a) locating said rotary valve in a first position to direct said waste gas stream through said first plurality of adjacent pie-shaped compartments, said hot clean gas stream through said second plurality of adjacent pie-shaped compartments and said purge gas through said third pies-shaped compartment;

(b) then rotating said rotary valve 180 degrees reversing gas flow through said rotary regenerative oxidizer and directing said waste gas stream through said second plurality of pie-shaped compartments and directing said hot clean gas stream through said first plurality of pie-shaped compartments and said purge gas into said fourth pie-shaped compartment;

(c) repeating step (b) multiple times for a time sufficient to burn off accumulated contaminants in said heat sink media in said third and fourth pie-shaped compartments sequentially;

(d) then indexing said rotary valve a pie-shaped compartment adjacent said first and second plurality of pie-shaped compartments and repeating step (b) for a time sufficient to burn off accumulated contaminants from heat sink media in a pie-shaped compartment adjacent said third and fourth pie-shaped compartments; and (e) repeating steps (d) and (b) to burn off accumulated contaminants from the heat sink media in all of said pie-shaped compartments.

* * * * *

UNITED STATES PATENT AND TRADEMARK OFFICE

CERTIFICATE OF CORRECTION

PATENT NO. : 6,974,318 B2
APPLICATION NO. : 10/818315
DATED : December 13, 2005
INVENTOR(S) : Sunjung Ahn, Donald I. McAnespie and Jason T. Schroeder It is certified that error appears in the above-identified patent and that said Letters Patent is hereby corrected as shown below:

Column 10, line 60, please delete the words “pies-shaped” and insert --pie-shaped--.

Signed and Sealed this

Eighteenth Day of July, 2006

JON W. DUDAS
*Director of the United States Patent and Trademark Office*